US007448145B2

(12) United States Patent
Kim

(10) Patent No.: US 7,448,145 B2
(45) Date of Patent: Nov. 11, 2008

(54) DRYER CONTROL METHOD AND DRYER USING THE SAME

(75) Inventor: Sang Doo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 58 days.

(21) Appl. No.: 11/583,034

(22) Filed: Oct. 19, 2006

(65) Prior Publication Data

US 2007/0033829 A1 Feb. 15, 2007

Related U.S. Application Data

(63) Continuation of application No. 10/926,997, filed on Aug. 27, 2004, now Pat. No. 7,171,763.

(30) Foreign Application Priority Data

Nov. 3, 2003 (KR) ..... 2003-0077236

(51) Int. Cl.
*F26B 19/00* (2006.01)

(52) U.S. Cl. ..... 34/562; 34/527; 34/471; 34/491; 34/572

(58) Field of Classification Search ..... 34/471, 34/491, 527, 562, 572, 528; 338/35; 236/44 E
See application file for complete search history.

(56) References Cited

U.S. PATENT DOCUMENTS 3,668,784 A 6/1972 Teague et al.
4,385,452 A 5/1983 Deschaaf et al.
5,050,313 A 9/1991 Wakaeya et al.
6,098,310 A 8/2000 Chen et al.
6,122,840 A 9/2000 Chbat et al.
6,493,963 B1 12/2002 England

*Primary Examiner*—Kenneth B Rinehart
(74) *Attorney, Agent, or Firm*—McKenna Long & Aldridge LLP

(57) ABSTRACT

A dryer and a dryer control method using a sensing unit and a timer to vary drying operations depending on the state of drying laundry are disclosed. The method for controlling an automatic dryer having a drying part including a heater, a fan, and a drum includes the steps of operating the drying part while monitoring an internal temperature and an internal humidity of the drum, continuously operating the heater, the fan, and the drum until the internal temperature reaches a predetermined temperature, and operating the fan intermittently when the internal temperature reaches the predetermined temperature. The method further includes operating the heater intermittently when the internal humidity reaches a predetermined humidity, discontinuing heater operation upon lapse of a first predetermined time, discontinuing fan operation upon lapse of a second predetermined time, and discontinuing drum operation upon lapse of a third predetermined time.

9 Claims, 4 Drawing Sheets

DRYER CONTROL METHOD AND DRYER USING THE SAME

This application is a Continuation of application Ser. No. 10/926,997 filed on Aug. 27, 2004, now U.S. Pat. No. 7,171,763 which is hereby incorporated by reference as if fully set forth herein, which claims the benefit of Korean Patent Application No. 2003-0077236 filed in Korea on Nov. 3, 2003, which is hereby incorporated by reference.

BACKGROUND OF THE INVENTION

1. Field of the Invention

The present invention relates to automatic dryers, and more particularly, to a dryer control method that uses a sensing unit and a timer to vary drying conditions depending on the state of drying laundry and to a dryer using the method.

2. Discussion of the Related Art

FIG. 1 illustrates a general dryer used for automatically drying wet laundry. Referring to FIG. 1, the dryer includes a drum 2 rotatably installed inside a case 1; a laundry inlet 3, formed in a front side of the case 1, for loading laundry; a door 4 installed at the laundry inlet 3; a motor 5, installed at an inner upper side of the case 1, for rotating the drum 2 using a drum belt 6; a plurality of lifters 7, installed on the inner circumferential surface of the drum 2, for tumbling laundry as the drum 2 rotates; a circulation duct 8, disposed between the case 1 and the drum 2, for circulating heated air; a heater 11, installed at one end of the circulation duct 8, for heating air; a fan 9, installed at one end of the circulation duct 8, for circulating the heated air; a fan belt 10, connected to the motor 5, for rotating the fan 9; an air supply duct 12, communicating with the circulation duct 8, for supplying external air to an interior of the dryer; and a condensation drain duct 13, also communicating with the circulation duct 8, for expelling condensed water generated when air is circulated inside the dryer.

In the operation of the above dryer, laundry to be dried is loaded in the drum 2 via the door 4, and upon activation of the dryer, the drum 2 containing the laundry is rotated by the motor 5, and the laundry is tumbled (or lifted) by the lifters 7. The fan 9, which is also driven by the motor 5, circulates air introduced through the air supply duct 12 to the circulation duct 8. The circulated air is heated by the heater 11, and hot air is introduced into the drum 2 to dry the laundry. Moisture generated by air circulated through the circulation duct 8 is expelled from the dryer through the condensation drain duct 13.

Since the dryer operating as above dries all types of laundry under the same drying condition, however, the drying time is too long. In addition, the drying state is poor, so that laundry may be damaged.

SUMMARY OF THE INVENTION

Accordingly, the present invention is directed to a dryer control method that substantially obviates one or more problems due to limitations and disadvantages of the related art.

An object of the present invention is to provide a dryer control method that can optimally dry laundry and reduce the drying time, by varying drying operations depending on the state of the drying laundry.

Another object of the present invention is to provide a dryer suitable for implementing the above method.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for controlling an automatic dryer having a drying part including a heater, a fan, and a drum includes the steps of operating the drying part while monitoring an internal temperature and an internal humidity of the drum, continuously operating the heater, the fan, and the drum until the internal temperature reaches a predetermined temperature, and operating the fan intermittently when the internal temperature reaches the predetermined temperature. The method further includes operating the heater intermittently when the internal humidity reaches a predetermined humidity, discontinuing heater operation upon lapse of a first predetermined time, and discontinuing fan operation upon lapse of a second predetermined time. Preferably, the method further includes a step of discontinuing drum operation upon lapse of a third predetermined time.

In another aspect of the present invention, a dryer includes a drying part, having a drum, for drying laundry in the drum, a sensing part for sensing drying conditions present inside the drum, and a control part for controlling operation of the drying part based on time information and the drying conditions sensed by the sensing part. The drying conditions include an internal temperature of the drum and an internal humidity of the drum, and the sensing part includes a temperature sensor for sensing an internal temperature of the drum and a humidity sensor for sensing an internal humidity of the drum, wherein voltage signals indicative of the sensed drying conditions are respectively output from the temperature sensor and the humidity sensor.

Preferably, the dryer further includes a memory for storing the time information and a timer for calculating operational time of the drying part, and the drying part of the dryer further includes a heater for heating air introduced into the drum according to a control signal of the control part, a fan for circulating air exiting the drum, and a motor for rotating the fan and the drum according to a control signal of the control part.

According to the present invention, a drying operation is executed in the drying part under the control of the control part and a stored algorithm. The drying operation can be divided into a series of operational periods, namely, periods for preheating, dehumidifying, drying, cooling, and crease-preventing. Each period is defined in relation to a controlled operation of the drying part—in particular, the operation of the heater and fan—and based on the lapse of time measured from the start of the drying operation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
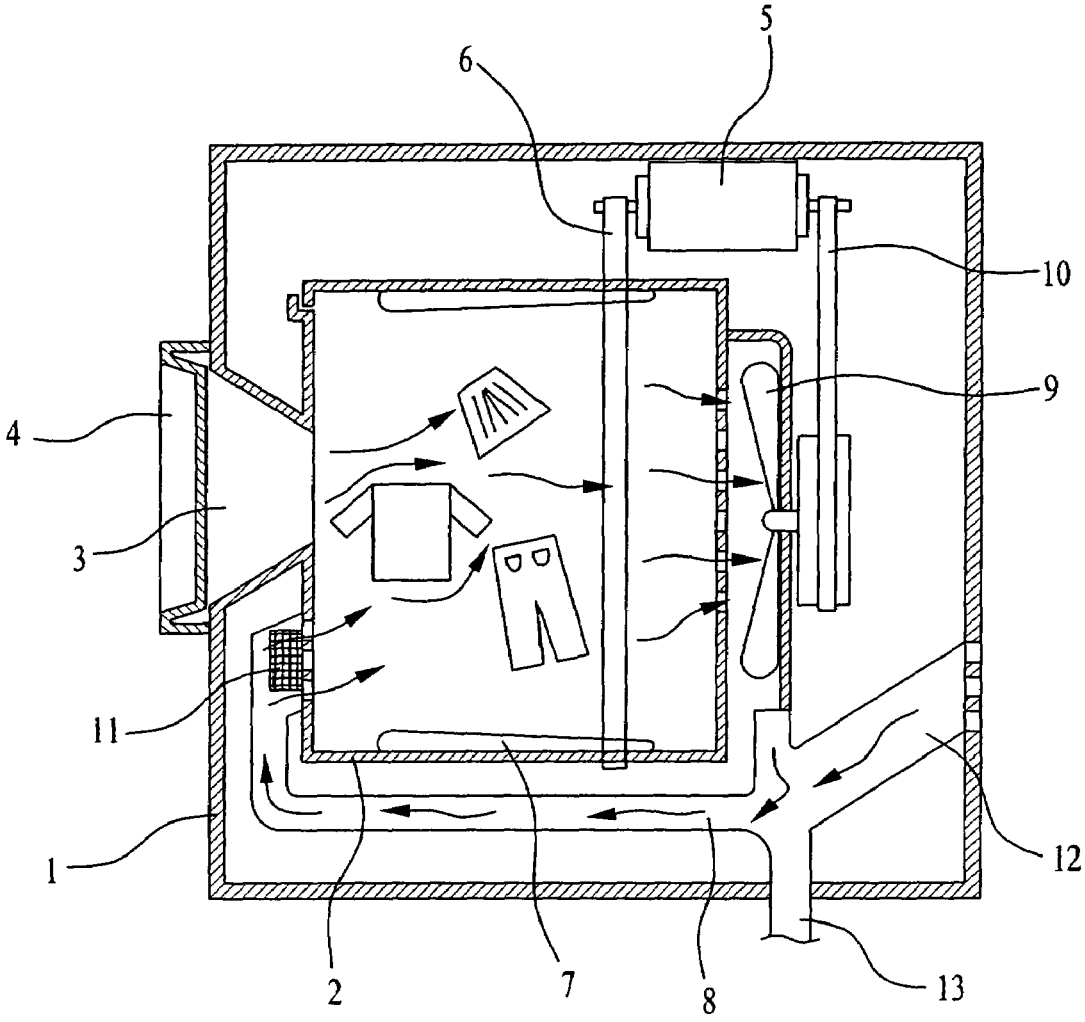
FIG. 1 Related Art
FIG. 1 is a schematic side view of a general dryer.
Figure 2:
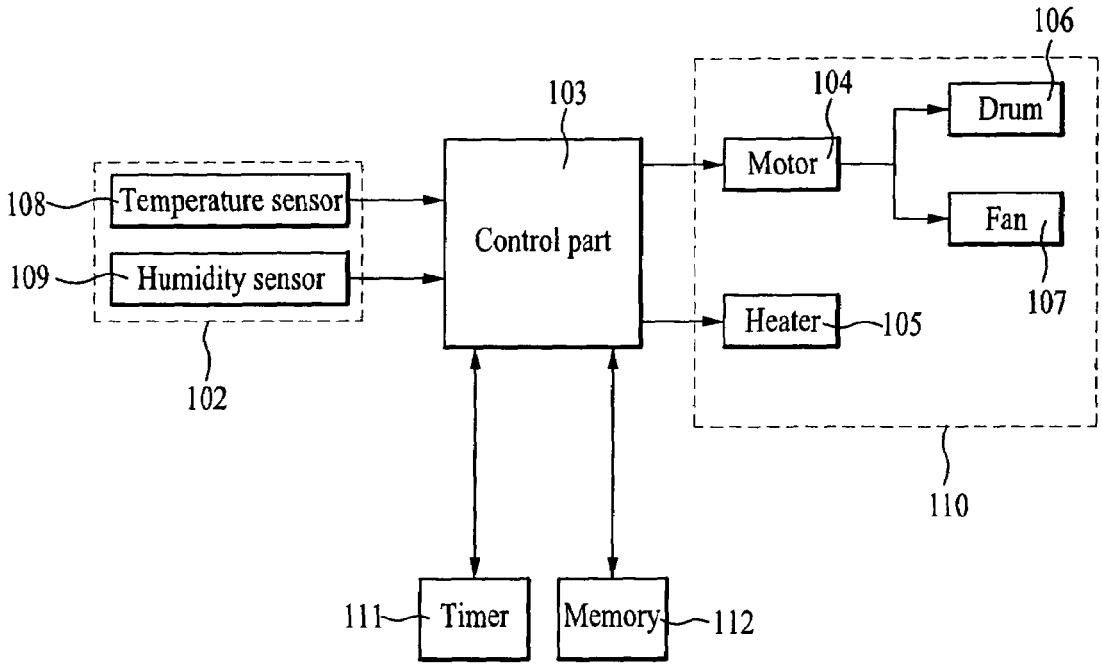
FIG. 2 is a block diagram of a dryer according to the present invention.

Referring to FIG. 2, illustrating a dryer according to the present invention, the dryer includes a drying part 110, a sensing part 102, and a control part 103. The drying part 110 includes a drum 106 for accommodating laundry to be dried, a heater 105 for heating air introduced into the drum 106 to dry the laundry according to a control signal of the control part 103, a fan 107 for circulating air exiting the drum 106, and a motor 104 for rotating the fan 107 and the drum 106 according to a control signal of the control part 103.

The sensing part 102 senses the humidity and temperature in the drum 106 and respectively outputs voltage signals indicative of the sensed the humidity and temperature. The sensing part 102 may include a temperature sensor 108 for sensing the drum's internal temperature and a humidity sensor 109 for sensing the drum's internal humidity.

The control part 103 outputs a plurality of control signals for variably controlling the operations of the drying part 110, including the drum 106, the heater 105, and the fan 107, using the voltage signals output by the sensing part 102 and time information measured with respect to an initiation of a drying operation and a series of predetermined time periods, which are based on an executed operation of the drying part 110. In doing so, the control part 103 executes an algorithm stored in the memory 112 using a timer 111 for calculating time, measured with respect to the predetermined time periods, and a memory 112 for storing current time information and a set of values representative of the predetermined time periods.

Figure 3:
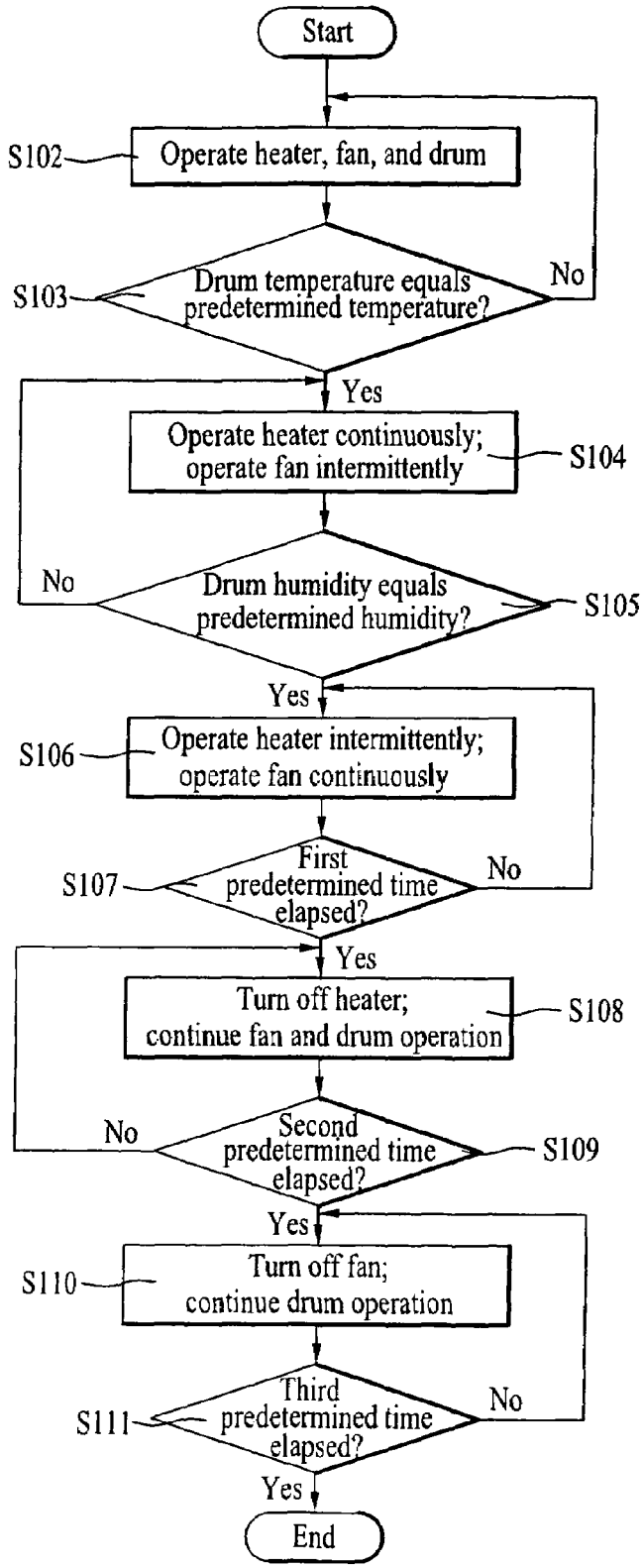
FIG. 3 is a flow diagram of a dryer control method according to the present invention.

FIG. 3 illustrates a method for controlling the dryer constructed as above. The method is executed according to a stored algorithm and is initiated upon input of a start command, which also initiates the timer 111. Throughout the ensuing operation of the drying part 110, the time information stored in the memory 112 is constantly updated, and the voltage signal output from the sensing part 102 is constantly monitored by the control part 103.

Referring to FIG. 3, upon input of a start command, the control part 103 respectively operates in a step S102 the drum 106, the heater 105, and the fan 107. That is, during a preheating period, the control part 103 operates the fan 107 near its operating capacity, e.g., approximately 80%, to raise the internal temperature of the drum 106 sharply within a short time, while monitoring the output voltage of the temperature sensor 108 of the sensing part 102. The control part 103 continues operating the fan 107 until determining in a step S103 that the internal temperature of the drum 106 has reached a predetermined temperature based on the output voltage of the temperature sensor 108 of the sensing part 102. The predetermined temperature is a temperature for rapidly drying the laundry. Control of the fan 107 may be achieved using an airflow meter (or high velocity airflow) or by simply varying the fan's rotational speed (or high rpm).

When the predetermined temperature is reached, in a step S104, the control part 103 continues to operate the drum 106 and heater 105 but begins to operate the fan 107 intermittently to maintain the internal temperature of the drum 106 at the predetermined temperature during a dehumidifying period. As an alternative to the fan's intermittent operation, the control part 103 may control the internal temperature of the drum 106, to maintain the predetermined temperature, by controlling only the airflow velocity/rotational speed of the fan 107.

The dehumidifying period continues until it is determined in a step S105 that the internal humidity of the drum 106 has reached a predetermined humidity, after which time a drying period begins. That is, in a step S106, the control part 103 continues to operate the drum 106 and fan 107 but begins to operate the heater 105 intermittently to maintain the internal humidity of the drum 106 at the predetermined humidity during the drying period.

Meanwhile, the time information stored in the memory 112 is used to determine in a step S107 whether a first predetermined time has elapsed. Upon lapse of the first predetermined time, in a step S108, a cooling period is started whereby the control part 103 turns off the heater 105 but continues to operate the fan 107 and drum 106.

The time information stored in the memory 112 is also used to determine in a step S109 whether a second predetermined time has elapsed. Upon lapse of the second predetermined time, in a step S110, a crease-preventing period is started whereby the control part 103 also turns off the fan 107, i.e., in addition to turning off the heater 105, but continues to operate the drum 106.

To determine the end of the crease-preventing period and thus the end of the drying operation, the time information stored in the memory 112 is used once again to determine in a step S111 whether a third predetermined time has elapsed. Thus, upon lapse of the third predetermined time, the control part 103 discontinues rotation of the drum 106 to thereby end the operation of the drying part 110.

Figure 4:
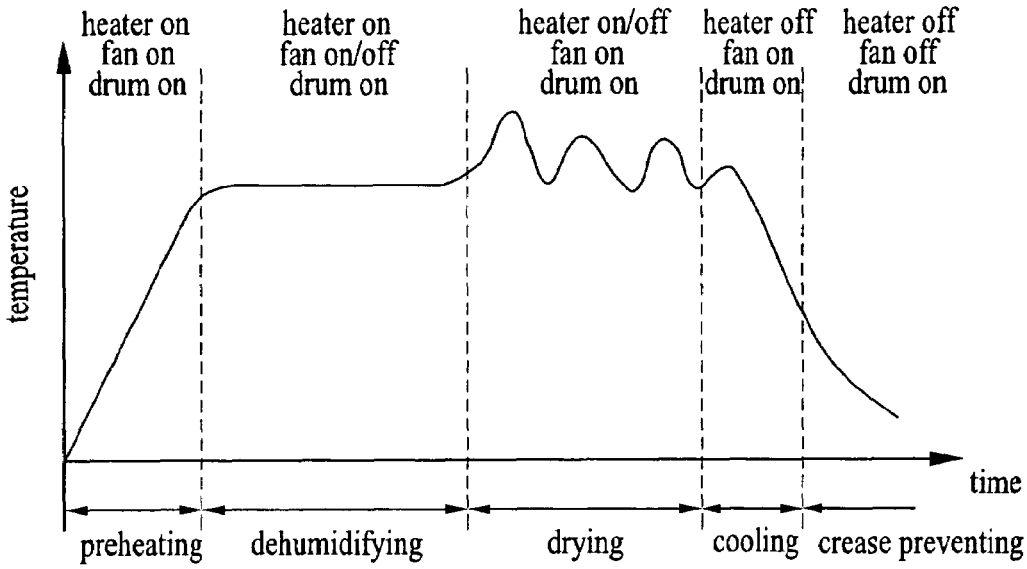
FIG. 4 is a graph showing drum temperature over drying time in a dryer adopting the present invention.

FIG. 4 shows drum temperature over drying time in a dryer adopting the present invention, illustrating an exemplar drying operation performed according to a stored algorithm. Referring to FIG. 4, the dryer control method of the present invention controls the respective operations of the drum, the heater, and the fan according to a series of time periods for optimally controlling a drying operation, i.e., the operation of the drying part 110. In the dryer control method of the present invention, operation the drying part 110 is controlled according to a series of operational periods for preheating, dehumidifying, drying, cooling, and crease-preventing.

During the preheating period, the control part 103 operates the heater 105, the fan 107, and the drum 106 to raise the drum temperature to a predetermined temperature for carrying out the dehumidifying period, during which time the control part 103 operates the fan 107 intermittently (or varyingly) to maintain the predetermined temperature, while continuing drum and heater operation. During the drying period, which begins when a predetermined humidity is reached, the control part 103 continues drum and fan operation but operates the heater 105 intermittently to maintain the predetermined humidity. During the cooling period, which begins upon a lapse of the first predetermined time, the control part 103 operates the drying part 110 with the heater 105 turned off. During the crease-preventing period, which begins upon a lapse of the second predetermined time, the control part 103 drives the drum 106 only. Upon a lapse of the third predetermined time, the control part 103 ceases the operation of the drying part 110 altogether.

Accordingly, since the present invention senses the state of laundry to vary the drying condition, the laundry can be optimally dried while reducing the drying time. A shorter drying time also minimizes laundry damage.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dryer comprising:

a drying part, having a drum, for drying laundry in the drum;

a sensing part for sensing drying conditions present inside the drum;

a control part for controlling operation of the drying part based on time information and the drying conditions sensed by the sensing part;

a memory for storing the time information; and a timer for calculating operational time of the drying part, wherein the time information is stored with respect to a series of predetermined time periods, wherein the predetermined time periods include a preheating period, a dehumidifying period, a drying period, a cooling period, and a crease-preventing period.

2. The dryer as claimed in claim 1, wherein the drying conditions include an internal temperature of the drum and an internal humidity of the drum.

3. The dryer as claimed in claim 1, wherein the sensing part outputs at least one voltage signal indicative of the sensed drying conditions.

4. The dryer as claimed in claim 1, wherein the predetermined time periods are based on an algorithm stored in the memory.

5. The dryer as claimed in claim 1, wherein the predetermined time periods occur serially beginning from an initial operation of the drying part.

6. The dryer as claimed in claim 5, wherein the drying part further comprises:

a heater for heating air introduced into the drum according to a control signal of the control part;

a fan for circulating air exiting the drum; and a motor for rotating the fan and the drum according to a control signal of the control part.

7. The dryer as claimed in claim 5, wherein, during the preheating period, the drum, the fan, and the heater operate, wherein, during the dehumidifying period, the drum and the heater operate continuously and the fan operates intermittently, wherein, during the drying period, the heater operates intermittently and the drum and the fan operate continuously, wherein, during the cooling period, the heater is turned off and the drum and the fan operate continuously, and wherein, during the crease-preventing period, the heater and the fan are turned off, and the drum rotates.

8. The dryer as claimed in claim 1, wherein the drying part further comprises:

a heater for heating air introduced into the drum according to a control signal of the control part;

a fan for circulating air exiting the drum; and a motor for rotating the fan and the drum according to a control signal of the control part.

9. The dryer as claimed in claim 1, wherein the sensing part comprises:

a temperature sensor for sensing an internal temperature of the drum; and a humidity sensor for sensing an internal humidity of the drum.

* * * * *